US007625321B2

(12) United States Patent
Simonson et al.

(10) Patent No.: US 7,625,321 B2
(45) **Date of Patent: *Dec. 1, 2009**

(54) CABLE CROSSOVER EXERCISE APPARATUS

(75) Inventors: Roy Simonson, Colorado Springs, CO (US); William T. Dalebout, North Logan, UT (US)

(73) Assignee: Icon IP, Inc, Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/627,322

(22) Filed: Jan. 25, 2007

(65) Prior Publication Data

US 2007/0167299 A1 Jul. 19, 2007

Related U.S. Application Data

(63) Continuation of application No. 10/358,993, filed on Feb. 5, 2003, now Pat. No. 7,169,093, which is a continuation-in-part of application No. 10/261,546, filed on Sep. 30, 2002, now Pat. No. 7,282,016, which is a continuation of application No. 09/864,246, filed on May 25, 2001, now Pat. No. 6,458,061, which is a continuation of application No. 09/395,194, filed on Sep. 14, 1999, now Pat. No. 6,238,323.

(51) Int. Cl.
*A63B 21/062* (2006.01)

(52) U.S. Cl. ..... 482/103; 482/138

(58) Field of Classification Search ..... 482/92–94, 482/97, 99–103, 126, 129, 130, 136–138
See application file for complete search history.

(56) References Cited

U.S. PATENT DOCUMENTS

| | | | |
|---|---|---|---|
| 321,388 | A | 6/1885 | Ruesbam |
| 353,089 | A | 11/1886 | Smith |
| 372,272 | A | 10/1887 | Murphy |
| 374,496 | A | 12/1887 | Reach |
| 457,400 | A | 8/1891 | Dowd |
| 722,462 | A | 3/1903 | Smith |
| 776,824 | A | 12/1904 | Bryon, Jr. |
| 807,670 | A | 12/1905 | Grabner |
| 1,928,089 | A | 9/1933 | Blickman |
| 2,436,987 | A | 3/1948 | Bailleaux |
| 2,472,391 | A | 6/1949 | Alzibu |
| 2,977,120 | A | 3/1961 | Morris |
| 3,708,166 | A | 1/1973 | Annas |
| 4,154,441 | A | 5/1979 | Gaida |
| 4,372,553 | A | 2/1983 | Hatfield |
| 4,402,504 | A | 9/1983 | Christian |
| 4,474,370 | A | 10/1984 | Oman |
| 4,531,727 | A | 7/1985 | Pitre |
| 4,603,855 | A | 8/1986 | Sebelle |

(Continued)

FOREIGN PATENT DOCUMENTS

DE 4410001 A1 * 8/1994

(Continued)

OTHER PUBLICATIONS

Cybex Expert Report—"Mechanical Engineering Analysis," 121 pages including tabs, Sep. 29, 2003.

(Continued)

*Primary Examiner*—Loan H Thanh
*Assistant Examiner*—Victor K Hwang
(74) *Attorney, Agent, or Firm*—Workman Nydegger

(57) ABSTRACT

A highly versatile exercise apparatuses is disclosed. More particularly, the invention relates to an exercise apparatus including a central weight stack and opposed extension arms. Upper and lower pulleys direct a cable into the opposed extension arms such that variations in the cable reaction and tension are minimized when either arm is moved.

35 Claims, 9 Drawing Sheets

U.S. PATENT DOCUMENTS

| | | | | |
|---|---|---|---|---|
| 4,632,388 | A | 12/1986 | Schleffendorf | |
| 4,635,926 | A | 1/1987 | Minkow | |
| 4,657,246 | A | 4/1987 | Salyer | |
| 4,666,151 | A | 5/1987 | Chillier | |
| 4,685,670 | A | 8/1987 | Zinkin | |
| 4,697,809 | A | 10/1987 | Rockwell | |
| 4,721,301 | A | 1/1988 | Drake | |
| 4,721,303 | A | 1/1988 | Fitzpatrick | |
| 4,733,860 | A | 3/1988 | Steffee | |
| 4,763,897 | A | 8/1988 | Yakata | |
| 4,784,384 | A | 11/1988 | Deola | |
| 4,826,157 | A | 5/1989 | Fitzpatrick | |
| 4,834,365 | A | 5/1989 | Jones | |
| 4,898,381 | A | 2/1990 | Gordon | |
| 4,900,018 | A | 2/1990 | Ish, III et al. | |
| 4,907,798 | A | 3/1990 | Burchatz | |
| 4,913,423 | A | 4/1990 | Farran et al. | |
| 4,974,838 | A | 12/1990 | Sollenberger | |
| 4,990,838 | A | 2/1991 | Kawato et al. | |
| 5,044,629 | A | 9/1991 | Ryan et al. | |
| 5,064,191 | A | 11/1991 | Johnson | |
| 5,090,694 | A | 2/1992 | Pauls et al. | |
| 5,102,121 | A | 4/1992 | Solow et al. | |
| 5,102,122 | A | 4/1992 | Paine, Jr. et al. | |
| 5,211,614 | A | 5/1993 | Henes | |
| 5,236,406 | A | 8/1993 | Webber | |
| 5,242,344 | A | 9/1993 | Hundley | |
| 5,250,013 | A | 10/1993 | Brangi | |
| D342,106 | S | 12/1993 | Campbell et al. | |
| 5,267,930 | A | 12/1993 | Henes | |
| 5,348,524 | A | 9/1994 | Grant | |
| 5,356,360 | A | 10/1994 | Johns | |
| 5,362,290 | A | 11/1994 | Huang | |
| 5,362,296 | A | 11/1994 | Wang et al. | |
| 5,417,634 | A | 5/1995 | Habing | |
| 5,429,569 | A | 7/1995 | Gunnari | |
| 5,549,530 | A | 8/1996 | Fulks | |
| 5,569,138 | A | 10/1996 | Wang et al. | |
| 5,667,465 | A | 9/1997 | McCollum et al. | |
| 5,674,167 | A | 10/1997 | Piaget et al. | |
| 5,709,638 | A | 1/1998 | Mackert | |
| 5,722,921 | A | 3/1998 | Simonson | |
| 5,738,616 | A | 4/1998 | Robertson | |
| 5,800,321 | A | 9/1998 | Webber | |
| 5,897,467 | A | 4/1999 | Habing et al. | |
| 5,906,566 | A | 5/1999 | Whitcomb | |
| 5,931,767 | A | 8/1999 | Morales | |
| 5,941,807 | A | 8/1999 | Cassidy et al. | |
| 5,951,444 | A | 9/1999 | Webber | |
| 5,961,428 | A | 10/1999 | Webber | |
| 5,989,165 | A | 11/1999 | Giannelli et al. | |
| 6,036,622 | A | 3/2000 | Gordon | |
| 6,217,493 | B1 | 4/2001 | Spletzer | |
| 6,238,323 | B1 | 5/2001 | Simonson | |
| 6,267,711 | B1 | 7/2001 | Hinds | |
| 6,443,877 | B1 | 9/2002 | Hoecht et al. | |
| 6,458,061 | B2 | 10/2002 | Simonson | |
| 6,488,612 | B2 | 12/2002 | Sechrest et al. | |
| 6,491,610 | B1 | 12/2002 | Henn | |
| 6,599,223 | B2 | 7/2003 | Wang et al. | |
| 6,669,607 | B2 | 12/2003 | Slawinski et al. | |
| 6,705,976 | B1 | 3/2004 | Piane, Jr. | |
| 7,169,093 | B2 * | 1/2007 | Simonson et al. | 482/103 |
| 7,172,538 | B2 | 2/2007 | Keiser | |
| 7,282,016 | B2 * | 10/2007 | Simonson | 482/103 |
| 7,396,319 | B1 | 7/2008 | Ellis | |
| 7,503,882 | B2 * | 3/2009 | Sechrest et al. | 482/103 |
| 2002/0013200 | A1 | 1/2002 | Sechrest et al. | |
| 2003/0017918 | A1 | 1/2003 | Webb et al. | |
| 2003/0032530 | A1 | 2/2003 | Sechrest et al. | |
| 2003/0032531 | A1 | 2/2003 | Simonson | |
| 2003/0060343 | A1 | 3/2003 | Sechrest et al. | |
| 2003/0114281 | A1 | 6/2003 | Mackert et al. | |
| 2003/0176261 | A1 | 9/2003 | Simonson | |
| 2006/0100069 | A1 * | 5/2006 | Dibble et al. | 482/98 |
| 2006/0116249 | A1 * | 6/2006 | Dibble et al. | 482/72 |
| 2009/0036277 | A1 * | 2/2009 | Ish et al. | 482/94 |

FOREIGN PATENT DOCUMENTS

| | | | |
|---|---|---|---|
| DE | 4331733 | | 5/1995 |
| DE | 19704390 | A1 | 9/1997 |
| DE | 19801672 | A1 | 11/1998 |
| SU | 1743620 | A1 | 11/1989 |
| SU | 1586724 | | 8/1990 |
| SU | 1725744 | A3 | 4/1992 |

OTHER PUBLICATIONS

Cybex Expert Report—"Supplemental Mechanical Engineering Analysis," 137 pages, Oct. 28, 2003.

Defendant Cybex International, Inc.'s Supplemental Responses to Plaintiff's Interrogatories and Document Requests, 46 pages, Sep. 29, 2003.

Defendant's [Nautilus's] Supplemental Responses to Plaintiffs First Set of Interrogatories, 45 pages, Aug. 8, 2003.

Cybex Expert Report—Letter from Michael W. Starkweather, 4 pages, Dec. 19, 2003.

Plaintiff Free Motion's Memorandum of Points and Authorities in Support of Its Motion for Partial Summary Judgment that Defendant Cybex Cannot, as a Matter of Law, Sustain Its Burden of Proving that the Asserted Claims of the Patents-in-Suit are Invalid, 229 pages including tabs, Aug. 29, 2003 [filed under seal and redacted accordingly].

Defendant Cybex's Memorandum in Support of Its Motion for Summary Judgment that the Patents-in-Suit are Invalid, and Alternative Request for Time to Do Additional Discovery of Prior Art; and Memorandum in Opposition to Plaintiff's Motion for Partial Summary Judgment that Cybex Cannot Sustain Its Burden of Proving that the Asserted Claims of the Patents-in-Suit Are Invalid, 694 pages including tabs, Sep. 29, 2003.

Plaintiff Free Motion's Reply Memorandum of Points and Authorities in Further Support of Its Motion for Partial Summary Judgment that Defendant Cybex Cannot, as a Matter of Law, Sustain Its Burden of Proving that the Asserted Claims of the Patents-in-Suit Are Invalid, 36 pages including tabs, Oct. 14, 2003.

Plaintiff Free Motion's Memorandum of Points and Authorities in Opposition to Defendant Cybex's Cross-Motion for Summary Judgment that the Patents-in-Suit Are Invalid, 47 pages including tabs, Oct. 29, 2003.

Defendant Cybex's Reply Memorandum in Support of Motion for Summary Judgment that the Patents-in-Suit Are Invalid, 180 pages including tabs, Nov. 14, 2003.

Free Motion Expert Report—"Infringement Analysis," 32 pages including tabs, Aug. 21, 2003.

Free Motion Expert Report—"Infringement Analysis," 31 pages including tabs, Dec. 11, 2003.

Plaintiff Free Motion's Memorandum of Points and Authorities in Support of Its Motion for Partial Summary Judgment of Literal Infringement of Claim 1 of the '061 Patent by Defendant Cybex's FT 360 Device, 140 pages including tabs, May 9, 2003 [filed under seal and redacted accordingly].

Corrigendum to Plaintiff Free Motion's Memorandum of Points and Authorities in Support of Its Motion for Partial Summary Judgment of Literal Infringement of Claim 1 of the '061 Patent by Defendant Cybex's FT 360 Device, 6 pages including tabs, May 12, 2003 [filed under seal and redacted accordingly].

Plaintiff Free Motion's (1) Reply Memorandum in Further Support of Its Motion for Partial Summary Judgment of Literal Infringement of Claim 1 of the '061 Patent by Defendant Cybex's FT 360 Device and (2) Memorandum of Points and Authorities in Opposition to Defendant Cybex's Cross-Motion for Partial Summary Judgment of No Literal Infringement of Claim 1 of the '061 Patent by Cybex's FT 360 Device, 15 pages, Jul. 2, 2003 [filed under seal and redacted accordingly].

Defendant Cybex's Reply Memorandum in Support of Motion for Partial Summary Judgment of No Infringement, 18 pages, Jul. 8, 2003.
Plaintiff Free Motion's Memorandum of Points and Authorities in Support of Its Motion for Partial Summary Judgment of Literal Infringrment of Claim 1 of the '061 Patent by Defendent's Freedom Trainer Device, 172 pages including tabs, Aug. 1, 2003.
Defendants' Memorandum in Support of Cross-Motion for Partial Summary Judgment of Non-Infringement Literally and in Opposition to Free Motion's Motion for Partial Summary Judgment of Literal Infringement of Claim 1 of the '061 patent, 29 pages, Sep. 30, 2003.
The Nautilus Group, Inc.'s Request for Judicial Notice in Support of its Reply to Cross-Motion for Partial Summary Judgment on Noninfringement Literally of Claim1 of the '061 Patent, 39 pages including tabs, Nov. 14, 2003.
Declaration of David M. Jacobson in Support of Nautilus's Cross-Motion for Partial Summary Judgment of Non-Infringement Literally and in Opposition to Free Motion's Motion for Partial Summary Judgment of Literal Infringement of Claim 1 of the '061 Patent, 13 pages including tabs, Sep. 30, 2003.
Declaration of Greg Webb in Support of Defendant's Cross-Motion of Non-Infringement and in Opposition to Free Motion's Motion for Partial Summary Judgment of Literal Infringement of Claim 1 of the '061, 25 pages including tabs, Sep. 30, 2003.
Plaintiff Free Motion's Reply Memorandum of Points and Authorities in Further Support of Its Motion for Partial Summary Judgment of Literal Infringement of Claim 1 of the '061 Patent by Defendant's Freedom Trainer Device, 55 pages including tabs, Oct. 15, 2003.
Plaintiff Free Motion's Memorandum of Points and Authorities in Opposition to Defendants' Cross-Motion for Partial Summary Judgment No Literal Infringement of Claim 1 of the '061 Patent by Defendants' Freedom Trainer Device, 23 pages, Nov. 3, 2003.
The Nautilus Group, Inc.'s Reply to Cross-Motion for Partial Summary Judgment of Noninfringement Literally of Claim 1 of the '061 patent, 12 pages, Nov. 18, 2003.
Plaintiff Free Motion's Memorandum of Points and Authorities in Support of Its Rule 60(b)(1) Motion for Relief From the Court's Order of Dec. 30, 2003, 46 pages including tabs, Feb. 4, 2004.
Nautilus's Opposition to Free Motion's Rule 60(b)(1) Motion for Relief From the Court's Order of Dec. 30, 2003, 11 pages, Feb. 19, 2004.
Defendant Cybex's Memorandum in Opposition to Plaintiff's Rule 60(b)(1)[sic] Motion for Relief From the Court's Order of Dec. 30, 2003, 83 pages including tabs, Feb. 23, 2004.
Plaintiff Free Motion's Reply Memorandum of Points and Authorities in Further Support of Its Rule 60(b)(1) Motion for Relief from the Court's Order of Dec. 30, 2003, 10 pages, Mar. 5, 2004.
The Nautilus Group, Inc.'s Memorandum in Support of Motion for Summary Judgment of Non-Infringement Literally and Under the Doctrine of Equivalents, 13 pages, Jan. 27, 2004.
Declaration of David M. Jacobson in Support of the Nautilus Group Inc.'s Motion for Summary Judgment of Non-Infringement Literally and Under the Doctrine of Equivalents, 46 pages including tabs, Jan. 27, 2004.
Plaintiff Free Motion's Opposition to Nautilus's Motion for Summary Judgment of Noninfringement, 158 pages including tabs, Mar. 8, 2004.
Declaration of Mark A. Lewis in Support of Plaintiff Free Motion's Opposition to Nautilus's Motion for Summary Judgment of Noninfringement Under the Doctrine of Equivalents, 13 pages, Mar. 8, 2004.
The Nautilus Group, Inc.'s Reply to Motion for Summary Judgment on Non-Infringement Literally and Under the Doctrine of Equivalents, 12 pages, Mar. 25, 2004.
Second Declaration of David M. Jacobson in Support of the Nautilus Group Inc.'s Motion for Summary Judgment of Non-Infringement Literally and Under the Doctrine of Equivalents, 8 pages including tabs, Mar. 25, 2004.
Defendant Cybex's Memorandum in Support of Motion for Complete Summary Judgment of Non-Infringement Literally and Under the Doctrine of Equivalents, 44 pages including tabs, Feb. 4, 2004.
Plaintiff Free Motion's Memorandum in Opposition to Cybex's Motion for Summary Judgment of Non-Infringement, 184 pages including tabs, Mar. 15, 2004.
Declaration of Mark A. Lewis in Support of Plaintiff Free Motion's Opposition to Cybex's Motion for Summary Judgment of Non-Infringement, 16 pages, Mar. 15, 2004.
Objection to Order Granting the Nautilus Group, Inc.'s Motion for Summary Judgment of Non-Infringement Literally and Under the Doctrine of Equivalence, 20 pages including tabs, Jun. 7, 2004.
Objection to Cybex's Proposed Summary Judgment Dismissing Plaintiff's Claims Against Defendant Cybex and Proposed Findings, Conclusions and Order Granting Cybex's Motion for Complete Summary Judgment of Non-Infringement, 20 pages including tabs, Jun. 7, 2004.
Cybex's Response to Plaintiff's Objection to Cybex's Proposed Order and Summary Judgment, 8 pages, Jun. 9, 2004.
Amended Objection to Proposed Order Granting the Nautilus Group, Inc.'s Motion for Summary Judgment of Non-Infringement Literally and Under the Doctrine of Equivalence, 7 pages, Jun. 10, 2004.
Response to Amended Objection to Proposed Order Granting the Nautilus Group, Inc.'s Motion for Summary Judgment of Non-Infringement Literally and Under the Doctrine of Equivalents, 5 pages, Jun. 11, 2004.
Memorandum Opinion & Order Re: Free Motion and Cybex's Cross-Motions for Summary Judgment as to Infringement of Claim One of Patent '061; and Free Motion and Nautilus' Cross Motions for Summary Judgment as to Infringement of Claim One of Patent '061, 20 pages, Dec. 30, 2003.
Order Denying Defendant Cybex's Motion for Summary Judgment That the Patents in Suit are Invalid, 5 pages, Apr. 15, 2004.
Order Denying Plaintiff Free Motion's Rule 60(b)(1) Motion for Relief From the Court's Order of Dec. 30, 2003, 5 pages, Apr. 15, 2004.
Order Denying Plaintiff Free Motion's Motion for Partial Summary Judgment That Defendant Cybex Cannot, as a Matter of Law, Sustain Its Burden of Proving that the Asserted Claims of the Patents in Suit are Invalid, 5 pages, Apr. 15, 2004.
Order Re: Defendant's Motions for Summary Judgment, 10 pages, Aug. 10, 2004.
Stipulation and Final Judgment, 6 pages, Aug. 31, 2004.
Plaintiff's Supplemental Responses to Defendant's First Set of Interrogatories, 11 pages, Oct. 21, 2002.
Plaintiff Ground Zero's Supplemental Initial Disclosures, 7 pages, Oct. 7, 2002.
Defendant's Objection to Plaintiff's First Set of Interrogatories, 4 pages, Sep. 6, 2002.
Defendant's Initial Disclosure Under Fed.R.Civ.P 26(a)(1), 8 pages, Jul. 31, 2002.
Plaintiff Ground Zero's Initial Disclosures, 5 pages, Jul. 31, 2002.
Plaintiff's Answers to Defendant's First Set of Interrogatories, 19 pages, Jul. 30, 2002.
Plaintiff Free Motion's First Supplemental Responses and Objections to Defendants' First Set of Interrogatories (Interrogatory Nos. 1 and 6), 36 pages, Aug. 5, 2003.
Defendant's Responses to Plaintiff's First Set of Interrogatories, 17 pages, Jul. 9, 2003.
Plaintiff Free Motion's Responses and Objections to Defendants' First Set of Interrogatories, 17 pages, Jun. 27, 2003.
Defendants' Fed.R.Civ.P. 26(a) Initial Disclosures, 3 pages, Jun. 10, 2003.
Rule 26(a) Initial Disclosures [Free Motion], 4 pages, Jun. 9, 2003.
Defendant's Supplemental Responses and Objections to Plaintiff's First Set of Interrogatories, 6 pages, Mar. 19, 2003.
Plaintiff's Third Supplemental Responses to Defendant's First Set of Interrogatories, 9 pages, Feb. 28, 2003.
Free Motion's Responses to Defendant's Second Set of Interrogatories, 28 pages, Feb. 18, 2003.
Defendant's Responses and Objections to Plaintiff's Second Set of Interrogatories, 15 pages, Feb. 11, 2003.
Plaintiff's Second Supplemental Responses to Defendant's First Set of Interrogatories, 14 pages, Feb. 7, 2003.
Supplemental Responses and Objections to Nautilus' First Set of Interrogatories to Free Motion (No. 7), 7 pages, Jan. 28, 2004.

Supplemental Rule 26(a) Initial Disclosures [Free Motion], 5 pages, Jan. 28, 2004.
Responses and Objections to Nautilus' Second Set of Interrogatories to Free Motion, 18 pages, Jan. 21, 2004.
Deposition of Stewart L. Gitler, 75 pages, Jun. 3, 2003.
Deposition of Howard Flaxman, 60 pages, Jun. 4, 2003.
Deposition of Roy Richard Simonson, vol. I, 82 pages, Mar. 10, 2003.
Deposition of Roy Richard Simonson, vol. II, 74 pages, Mar. 11, 2003.
Deposition of Roy Richard Simonson, vol. III, 78 pages, Mar. 12, 2003.
Deposition of William Dalebout, 83 pages, Mar. 13, 2003.
Deposition of Tom Neppl, 39 pages, Mar. 4, 2003.
Deposition of Rich A. Compton, 42 pages, Mar. 3, 2003.
Plaintiff Free Motion's Reply to the Amended Counterclaim of Defendant Cybex, 7 pages, Dec. 2, 2002.
Second Amended Complaint of Patent Infringement (Jury Trial Demanded), 35 pages with tabs, Nov. 8, 2002.
Amended Answer, Affirmative Defenses and Counterclaims of the Nautilus Group, Inc. and Nautilus Human Performance Systems, Inc., 9 pages, Sep. 11, 2003.
Plaintiff Free Motion's Reply to the Amended Answer, Affirmative Defenses and Counterclaims of the Nautilus Group, Inc. and Nautilus Human Performance Systems, Inc., 8 pages, Oct. 14, 2003.
Amended Complaint for patent Infringement (Jury Trial Demanded), 35 pages with tabs, Oct. 30, 2002.
Amended Answer of Defendant Cybex International, Inc. to Amended Complaint of Patent Infringement and Amended Counterclaim to Plaintiff's Amended Complaint, 76 pages including tabs, Nov. 13, 2002.
Brief for Appellant Free Motion Fitness, Inc., 110 pages, Dec. 6, 2004.
Brief of Defendant—Appellee Cybex International, Inc., 80 pages, Jan. 14, 2005.
Brief of Appellees The Nautilus Group, Inc., et al. 45 pages, Jan. 18, 2005.
Reply Brief for Appellant Free Motion Fitness, Inc., 45 pages, Feb. 4, 2005.
Joint Appendix (vol. I of II—pp. A1 to A1928), 466 pages, Feb. 11, 2005.
Joint Appendix (vol. II of II—pp. A1956 to A3991), 444 pages, Feb. 11, 2005.
Notice of Entry of Judgment Accompanied by Opinion, 28 pages, Sep. 16, 2005.
Cybex International, Inc.'s Combined Petitions for Panel Rehearing and Rehearing En Banc, 48 pages, Sep. 28, 2005.
Petition for Panel Rehearing and Rehearing En Banc of Defendants-Appellees The Nautilis Group, Inc. (f/k/a/ Direct Focus, Inc.) and Nautilus Human Performance Systems, Inc., 48 pages, Sep. 29, 2005.
Judgment (Issued as a Mandate), 28 pages, Nov. 10, 2005.
Ground Zero, *Strength Training Equipment*, Owner's Manual, upon information and belief, availabel at least as early as Jan. 2001 (80 pages (excluding section dividers)).
Paramount Functional Trainer PFT-200, upon information and belief, available at least as early as Jul. 1, 2004, available at http:/www.paramountfitness.com/showroom/pft/page_pft.html.
New Product Introductions for 2002, upon information and belief, available at least as early as Jun. 9, 2005, available at http://fitnessmanagement.com/FM/tmpl/genPage.asp?p=/information/articles/library/features/0102features—1.html.
Office Action dated Apr. 25, 2000, from U.S. Appl. No. 09/395,194, (4 pages).
Office Action dated May 9, 2000, from U.S. Appl. No. 09/395,194 (5 pages).
Office Action dated Nov. 8, 2000, from U.S. Appl. No. 09/395,194 (5 pages).
Examiner's Interview Summary dated Jan. 17, 2001, from U.S. Appl. No. 09/395,194 (1 page).
Notice of Allowance dated Feb. 22, 2001, from U.S. Appl. No. 09/395,194, (3 pages).
Issue notification dated May 11, 2001, from U.S. Appl. No. 09/395,194 (1 page).
Office Action dated Dec. 18, 2001, from U.S. Appl. No. 09/864,246 (4 pages).
Notice of Allowability and Examiner's Amendment dated Jul. 12, 2002, from U.S. Appl. No. 09/864,246 (3 pages).
Notice of Allowance and fees paid dated Jul. 12, 2002, from U.S. Appl. No. 09/864,246 (2 pages).
Issue Notification dated Sep. 12, 2002, from U.S. Appl. No. 09/864,246 (1 page).
Office Action dated Dec. 31, 2002, from U.S. Appl. No. 10/261,546 (7 pages).
Office Action dated Aug. 13, 2003, from U.S. Appl. No. 10/261,546 (6 pages).
Notice of Allowance dated Mar. 9, 2004, from U.S. Appl. No. 10/261,546 (6 pages).
Office Action dated Jul. 14, 2004, from U.S. Appl. No. 10/261,546 (10 pages).
Examiner's Interview Summary dated Oct. 14, 2004, from U.S. Appl. No. 10/261,546 (3 pages).
Office Action dated Feb. 18, 2005, from U.S. Appl. No. 10/261,546 (9 pages).
Examiner's Interview Summary dated Oct. 20, 2005, from U.S. Appl. No. 10/261,546 (2 pages).
Office Action dated Nov. 2, 2005, from U.S. Appl. No. 10/261,546 (8 pages).
Office Action dated Jun. 9, 2006, from U.S. Appl. No. 10/261,546 (7 pages).
Examiner's Interview Summary dated Aug. 1, 2006, from U.S. Appl. No. 10/261,546 (2 pages).
Notice of Abandonment from U.S. Appl. No. 10/261,546 (3 pages).
Petition Decision dated Dec. 4, 2006, from U.S. Appl. No. 10/261,546 (1 page).
Office Action dated Dec. 12, 2006, from U.S. Appl. No. 10/261,546 (9 pages).
Examiner's Interview Summary dated May 18, 2007, from U.S. Appl. No. 10/261,546 (2 pages).
Notice of Allowance dated May 18, 2007, from U.S. Appl. No. 10/261,546 (5 pages).
Issue Notification dated Sep. 26, 2007, from U.S. Appl. No. 10/261,546 (1 page).
Office Action dated Jul. 11, 2005, from U.S. Appl. No. 10/358,993 (12 pages).
Examiner's Interview Summary dated Jun. 27, 2006, from U.S. Appl. No. 10/358,993 (1 page).
Examiner's Interview Summary dated Sep. 22, 2006, from U.S. Appl. No. 10/358,993 (3 pages).
Notice of Allowance dated Sep. 28, 2006, from U.S. Appl. No. 10/358,993 (6 pages).
Issue Notification dated Jan. 10, 2007, from U.S. Appl. No. 10/358,993 (1 page).
FreeMotion Cable Cross Owner's Manual (Model No. GZFM60063), pp. 1-16, Printed in USA 2003, Icon Health & Fitness.
FreeMotion Cable Cross Owner's Manual (Model No. GZFM60064), pp. 1-16, Printed in USA 2003, Icon Health & Fitness.
Paramount PFT-200 Functional Trainer, Paramount Fitness Corp. Brochure printed Jul. 2003, 4 pages.
U.S. Appl. No. 11/178,715, filed Sep. 30, 2008, Office Action in U.S. Appl. No. 11/178,715 (copy attached).
Catalog of Gymnastic Apparatus, Narragansett Machine Company, Copyright 1925, p. 23.
Product brochure for Cybex International, Inc. the Cybex FT 360 Functional Trainer, Copyright 2000.
Website for Cybex, Jun. 7, 2001.
Cybex: A passion for human performance™, FT 360 Functional Trainer Owner's Manual, Jun. 2000.
Office Action dated Jun. 23, 2009 cited in U.S. Appl. No. 11/178,715 (Copy Attached). (15420.50.1).

* cited by examiner

CABLE CROSSOVER EXERCISE APPARATUS

CROSS-REFERENCE TO RELATED APPLICATIONS

This patent application is a continuation of U.S. patent application Ser. No. 10/358,993, filed on Feb. 5, 2003, entitled "Cable Crossover Exercise Apparatus", which is a continuation-in-part of U.S. patent application Ser. No. 10/261,546, filed on Sep. 30, 2002, entitled "Cable Crossover Exercise Apparatus", inventor Roy Simonson, which is a continuation of U.S. patent application Ser. No. 09/864,246, filed on May 25, 2001, entitled "Cable Crossover Exercise Apparatus", inventor Roy Simonson, now U.S. Pat. No. 6,458,061, which is a continuation of U.S. patent application Ser. No. 09/395,194, filed on Sep. 14, 1999, entitled "Cable Crossover Exercise Apparatus", now U.S. Pat. No. 6,238,323, each of which is incorporated herein in its entirety by reference.

BACKGROUND OF THE INVENTION

1. The Field of the Invention

The invention is in the field of cable crossover exercise apparatuses having a central weight stack and opposed extension arms.

2. The Relevant Technology

Exercise apparatuses commonly employ a weight stack actuated by a cable which is pulled by users of the apparatus. Some of such arrangements can present certain limitations affecting the usefulness of the exercise apparatus. For example, the range of exercises which may be performed with certain cable actuated apparatuses is sometimes limited by the effective length of cable linking the weight stack with the user. The effective useful length of the cable may be limited by the height of the weight stack; in such systems, for example, for each foot the cable is pulled by the user, the weight stack may be required to rise a proportional distance. Where the rise of the weight stack is substantially equal to the distance which the cable is pulled, the effective useful length of the cable is often limited to only a few feet since building weight stacks any larger can be cost prohibitive, or structurally undesirable.

Certain weight stack based exercise apparatuses also encounter problems as a result of the momentum created when the weight plates are lifted under the control of a cable. Specifically, when the weight plates are lifted upwardly at a fast pace, the generated momentum can create momentary reductions and increases in the perceived force encountered by the user. Such momentary changes are highly undesirable.

Some weight stack based exercise apparatuses also encounter problems with the cable catching or binding on the frame, support arms, or other parts of the assembly. Certain weight stacks also have cables that shorten or lengthen when a support arm(s) that contacts the cable moves upward or downward. Such shortening or lengthening can cause the handles coupled to the cables to inconveniently dangle an excessive distance downwardly from the support arm(s). As a result, a need further exists for an exercise apparatus overcoming the shortcomings of prior art cable assemblies.

BRIEF SUMMARY OF THE INVENTION

The present invention provides an exercise apparatus including a resistance assembly having a base and a weight stack assembly. Right and left extension arms each include a proximal end pivotally coupled to the resistance assembly, and a free distal end from which respective first and second ends of the cable extend. Upper and lower guide pulleys are attached to each end of the resistance assembly adjacent the proximal ends of the right and left extension arms.

The upper and lower guide pulleys are positioned such that when the extension arms are pivoted so that they are at a generally upward angle, the cable contacts at least the upper pulley. When the extension arms are pivoted so that they are at a generally downward angle, the cable contacts at least the lower pulley. In one embodiment of the invention, when the extension arms are pivoted so that they are at a generally downward angle, the cable contacts both the upper and lower pulleys.

The configuration of the upper and lower pulleys ensures that the cable is properly positioned with respect to the respective extension arm regardless of whether the extension arm is in an upper position or a lower position. This orientation of the pulleys allows the cable to move freely without binding, regardless of the orientation of the extension arms. This orientation also minimizes the shortening or lengthening of the portion of the cable extending from the distal ends of the extension arms when the arms are moved upwardly or downwardly.

DETAILED DESCRIPTION OF THE PREFERRED EMBODIMENTS

Figure 1:
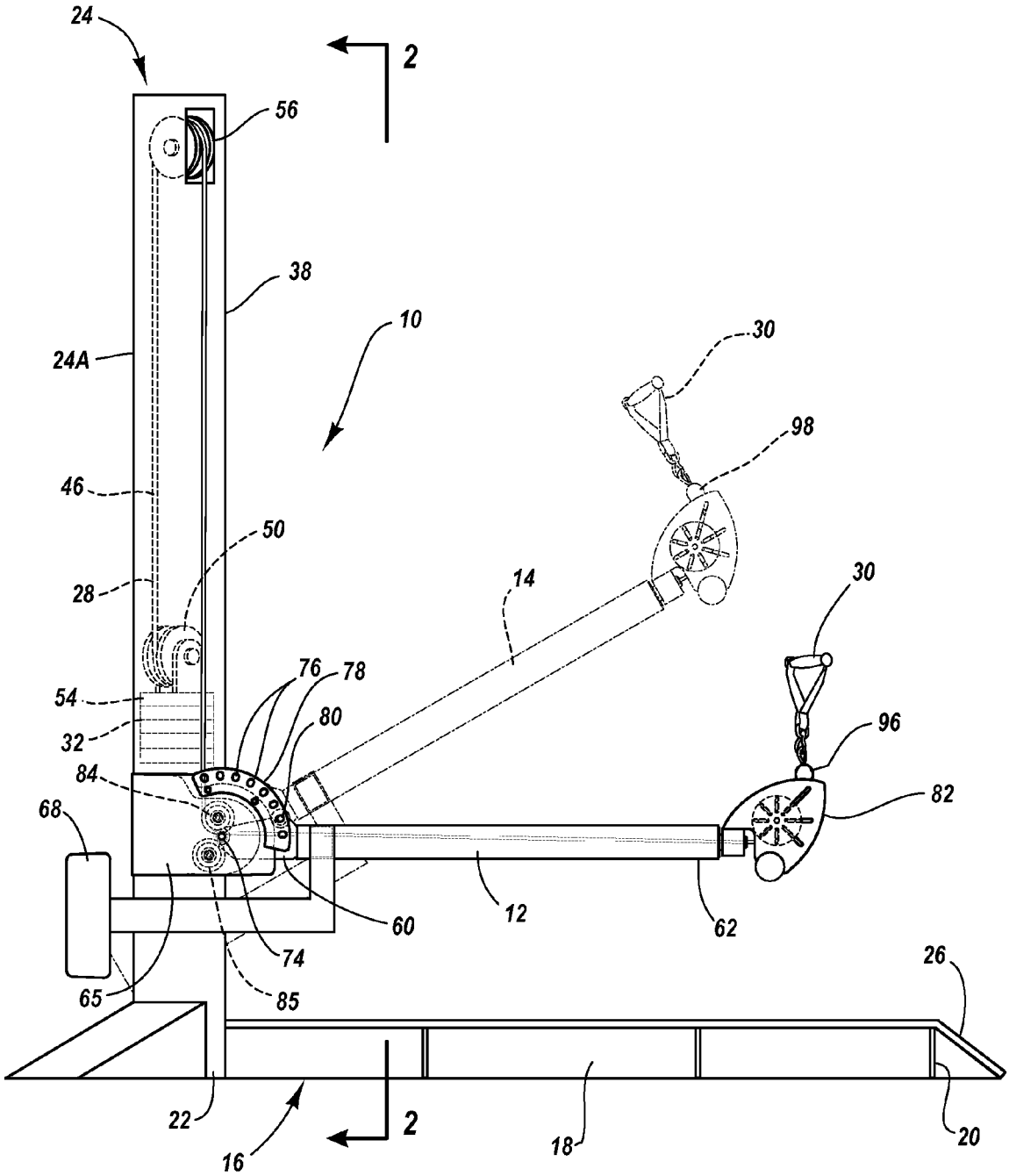
FIG. 1 is a side view of an exercise apparatus of the present invention.
Figure 2:
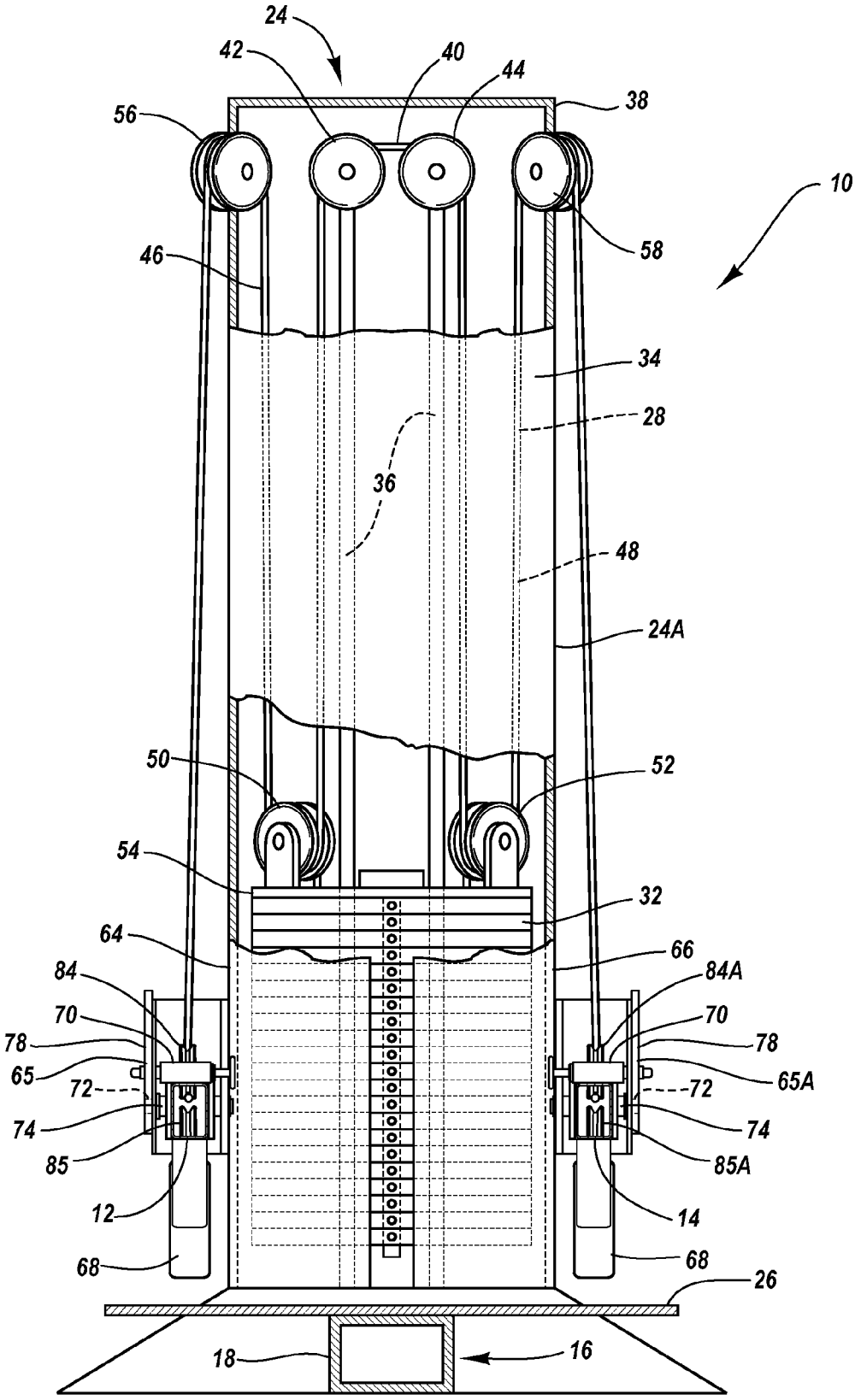
FIG. 2 is a frontal view of the exercise apparatus of FIG. 1 along the line 2-2 with the weight stack shown in partial cross section.
Figure 3:
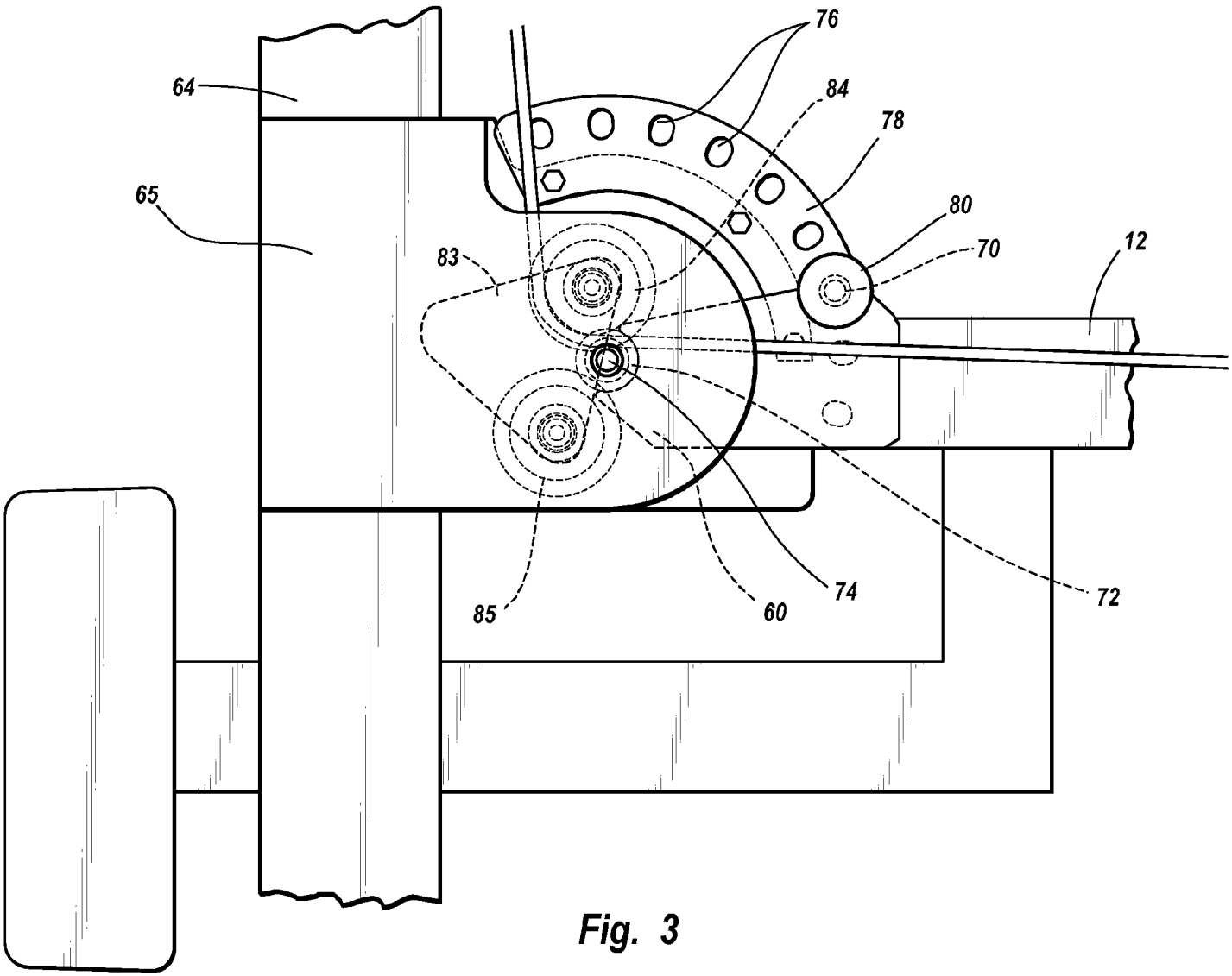
FIG. 3 is a cutaway side view of the first end of the extension arm of the exercise apparatus of FIG. 1.

With reference to FIGS. 1-3, an exercise apparatus 10 is disclosed. The exercise apparatus 10 includes a resistance assembly 24 having (i) a base 16; and (ii) a weight stack assembly 24A. Right and left extension arms 12, 14 each include a proximal end 60 pivotally coupled to the resistance assembly 24, and a free distal end 62 from which respective first and second ends 46, 48 of a cable 28 linked to the resistance assembly 24 extend.

The resistance assembly includes a base structure 16 having a central user support member 18 with a free first end 20 and a second end 22 to which the weight stack assembly 24A is secured. The central user support member 18 includes a platform 26 sized, shaped and constructed to support a standing user while he or she operates the exercise apparatus 10.

A single cable 28 links the user handles 30 to the weight stack assembly 24A. In one embodiment, the cable 28 is run through a series of pulleys to provide a 4:1 load ratio for each handle 30. In this way, a four hundred pound stack of weight plates 32 may be moved by the application of one hundred pounds force at each handle 30 (two hundred pounds total force when both handles are used simultaneously).

The 4:1 ratio reduces the inertia of the weight plates 32 by reducing the rate of movement of the weight plates 32 compared to the rate of travel at the handle 30. Single hand movements allow the handle 30 to move four times faster than the weight plates 32 and dual hand movement allows the handles 30 to move twice the speed of the weight plates 32. The 4:1 ratio also provides single hand movements equal in length to four times the travel distance of the weight plates 32. This allows extended movements, such as, for example, overhead lift and bicep curls in addition to the dead lift movements, to provide users with greater flexibility in choosing a desired resistance level.

The series of pulleys over which cable 46 moves includes a first guide pulley 84 and a second guide pulley 85 located adjacent the proximal end of the right extension arm 12. Corresponding guide pulleys 84A, 85A are located adjacent the proximal end of the left extension arm 14. Guide pulleys 84, 84A are upper pulleys, while guide pulleys 85, 85A are lower pulleys.

As illustrated in FIG. 1, when the arm 12 is located in a first position the cable 28 contacts pulley 84. When the arm 12 is lowered to a second position, the cable 28 contacts pulley 85 as well as pulley 84.

Referring now to FIG. 2, the weight stack assembly 24A includes a support frame 34 with vertical support members 36 aligned to support the stack of weight plates 32. The weight plates 32 are supported for movement up and down in a conventional manner. The pulleys and cable 28 are used to lift weight plates 32. The weight stack assembly 24A includes a protective sleeve 38 positioned about the support frame 34 and the stack of weight plates 32.

Cable 28 actuates the weight stack assembly 24A and controls the movement of the weight plates 32. The central portion 40 of cable 28 is passed over first and second central upper pulleys 42, 44.

Opposing ends 46, 48 of cable 28 then extend downwardly within the weight stack assembly 24A to respectively engage first and second movement pulleys 50, 52. The movement pulleys 50, 52 are attached to a coupling member 54 attached to the stack of weight plates 32 (e.g., through the use of a perforated selector rod and an insertable locking pin). In this way, upward movement of the movement pulleys 50, 52 causes the coupling member 54 to move upwardly, and ultimately lift weight plates 32 against the force of gravity.

The first and second ends 46, 48 then extend upwardly and respectively pass over respective first and second exit pulleys 56, 58. After passing over the exit pulleys 56, 58 and exiting the confines of the weight stack assembly 24A, the ends 46, 48 extend downwardly until they contact the upper and lower guide pulleys 84, 84A, 85, and 85A, then enter the respective right and left extension arms 12, 14. Although a preferred orientation is disclosed for the various pulleys used in accordance with the present invention, those skilled in the art will readily understand that the exact orientation of the pulleys may be varied without departing from the spirit of the present invention.

The right and left extension arms 12, 14 are pivotally coupled to mounting brackets 65, 65*a*, which are fixed to the weight stack assembly 24A. Each extension arm 12, 14 pivots about a pivot axis and, in one embodiment, the pivot axes of the right and left extension arms 12, 14 are substantially aligned.

In the embodiments shown in FIGS. 1-3, the right and left extension arms 12, 14 are substantially identical and will now be described with reference to at least the right extension arm 12. Referring to FIGS. 1-3, the right extension arm 12 includes a proximal end 60 and a distal end 62. The proximal end 60 of the right extension arm 12 is pivotally coupled to a mounting bracket 65, which is fixed to a first side 64 of the weight stack assembly 24A. The proximal end 60 of the left extension arm 14 is pivotally coupled to mounting bracket 65*a* which is fixed to the opposite side 66 of the weight stack assembly 24A. The left and right extension arms 12, 14 are pivotally coupled in a manner allowing a user to select a desired orientation for the arms relative to the weight stack assembly 24A and to lock the arms 12, 14 in place. Movement of the right and left extension arms 12, 14 is assisted by the inclusion of a counterweight 68 at the proximal end 60 of the arms.

The right extension arm 12 includes a locking hole 70 (FIG. 3). The locking hole 70 is located adjacent a pivot hole 72 through which a pivot pin 74 passes to pivotally couple the right extension arm 12 to the weight stack assembly 24A. The locking hole 70 is aligned with a series of flange holes 76 formed on a semicircular flange 78 of the weight stack assembly 24A. The semicircular flange 78 is positioned substantially parallel to the plane in which the right extension arm 12 pivots as it moves relative to the weight stack assembly 24A.

In practice, and, as those skilled in the art will readily appreciate, a locking pin 80 is passed though an aligned locking hole 70 and flange hole 76 to lock the extension arm 12 at a desired angular orientation relative to the weight stack assembly 24A. When a user desires to change the angular orientation of the right extension arm 12, the locking pin 80 is simply removed and the locking hole 70 is aligned with another flange hole 76 at which time the locking pin 80 is once again inserted in position to lock the right extension arm 12 relative to the weight stack assembly 24A.

First and second guide pulleys 84, 85 are fixed to the mounting bracket 65 near end 60 of the right extension arm 12. Corresponding third and fourth guide pulleys 84A, 85A, operate in a similar fashion with respect to the left extension arm 14.

Depending on the position of the extension arm 12, the first end 46 of the cable 28 passes over at least one of the guide pulleys 84, 85 and possibly both guide pulleys 84, 85 before entering the tubular passageway formed in the right extension arm 12. As shown in FIGS. 1-3, if the right extension arm 12 is positioned at an upward angle from the horizontal, the first end 46 of the cable 28 comes down from pulley 56 at the top of weight stack assembly 24A, passes around the first guide pulley 84 and enters the tubular passageway in the right extension arm 12.

On the other hand, if the right extension arm 12 is positioned at a downward angle, the first end 46 of the cable 28 comes down from pulley 56 at the top of weight stack assembly 24A, passes around the first guide pulley 84 and then the second guide pulley 85, and then enters the tubular passageway in the right extension arm 12. This orientation of the first and second guide pulleys 84, 85, (and guide pulleys 84A, 85A, which may be identically or similarly oriented for the left extension arm 14) allows the cable 28 to move freely within the tubular passageway without binding regardless of the orientation of the extension arms. This orientation further minimizes variations in the length and tension of the cable 28 as at least one of the extension arms is moved upwardly or downwardly. Thus, cable tension does not vary substantially as one or both extension arms 12, 14 are moved from an upper position to a lower position.

Upon reaching the distal end 62 of the right extension arm 12, the first end 46 passes over the pivoting pulley assembly 82 and is ready for engagement by a user of the present apparatus. The distal end of the first end 46 of the cable 28 may be fitted with a wide variety of handles 30 known to those skilled in the art.

Figure 4:
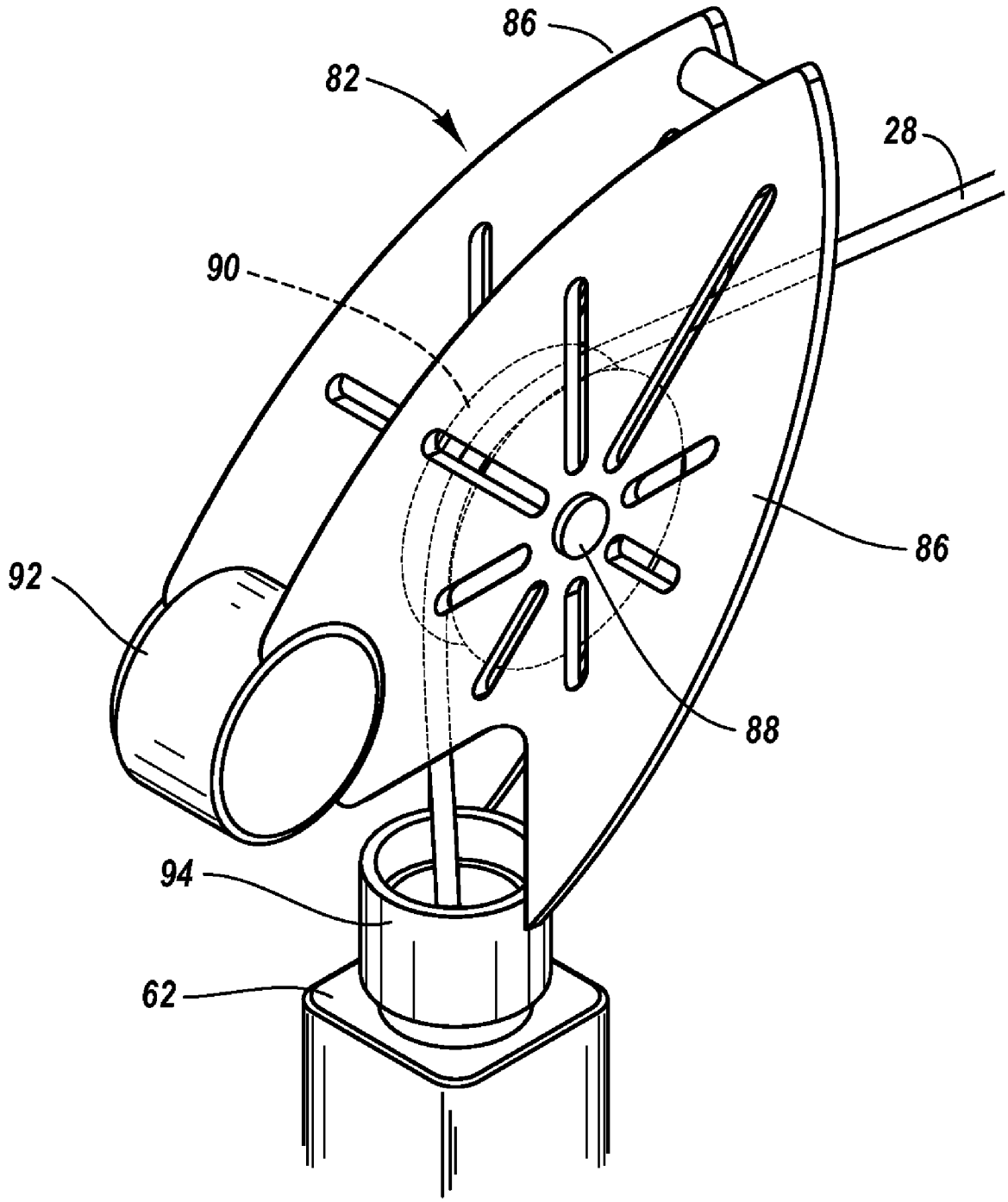
FIG. 4 is a perspective view of a pivoting pulley assembly of the exercise apparatus of FIG. 1.

Referring briefly to FIGS. 1 and 4, the distal end 62 of the right extension arm 12 is fitted with a pivoting pulley assembly 82 which guides the first end 46 of the cable 28 as it exits the right extension arm 12. The pivoting pulley assembly 82 is shown in greater detail in FIG. 4. Each pivoting pulley assembly 82 includes a frame 86 with a central pivot 88 for rotatably supporting a pulley member 90. The frame 86 is formed so as to cover the pulley member 90 and thereby prevent undesired access with the pulley member 90 as the cable 28 passes thereover. The frame 86 is further provided with a counterweight 92 opposite the pulley member 90.

The frame 86 further includes a cylindrical coupling member 94 shaped and dimensioned for pivotal attachment to the distal end 62 of the extension arms 12, 14. The cylindrical coupling member 94 provides an opening through which the cable 28 passes as it extends from the extension arms 12, 14 toward the pulley member 90. In this way, the cable 28 passes along the axis about which the pivoting pulley assembly 82 pivots relative to the extension arms 12, 14 to provide greater freedom of motion as an individual attempts to draw the cable 28 in various directions during exercise.

Since the pivoting pulley assembly 82 permits a great degree of flexibility with regard to the angle at which the cable 28 is drawn from the extension arms 12, 14 the inclusion of the present pivoting pulley assemblies 82 at the distal end of each extension arm 12, 14 greatly increases the flexibility of the present exercise apparatus.

The respective ends of the first and second ends 46, 48 are each provided with stop members 96, 98. As those skilled in the art will readily appreciate, the stop members 96, 98 control motion of the single cable 28 to allow exercise by pulling the first end 46 alone, the second end 48 alone, or both ends at the same time. The guide pulleys 84, 85 are positioned such that the stop members remain substantially in contact with the pivoting pulley assembly 82 regardless of the position of the arm. The guide pulleys 84, 85 thus provide sufficient tension on the cable 28 to prevent the handles 30 coupled to the ends 46, 48 from dangling excessively from the extension arms 12, 14, regardless of whether the arms 12, 14 are in an upward or a downward position.

In use, and after the right and left extension arms 12, 14 are properly positioned in a desired orientation, the user stands upon the central member 18, grips the handles 30 secured to the ends of the respective ends and performs the desired lifting exercises.

With reference to FIGS. 5-8, another embodiment of the exercise apparatus 110 of the present invention is disclosed. Exercise apparatus 110 includes a pair of extension arms 112, 114 positioned to facilitate a wide range of lifting type exercises. The extension arms 112, 114 of the exercise apparatus 110 extend outwardly in different directions to provide the user with access to cable ends positioned for gripping when a user fully extends his or her arms outwardly in opposite directions.

The exercise apparatus 110 includes a resistance assembly 124 having (i) a base 116; and (ii) a weight stack assembly 124A. Right and left extension arms 112, 114 each include a proximal end 160 pivotally coupled to the resistance assembly 124, and a free distal end 162 from which respective first and second ends 146, 148 of a cable 128 linked to resistor assembly 124 extend.

A single cable 128 links the user handles 130 to the weight stack assembly 124A. In one embodiment, the cable 128 is run through a series of pulleys to provide a 4:1 load ratio for each handle. In this way, a four hundred pound weight stack may be moved by the application of one hundred pounds force at each handle 130 of the device 110 (two hundred pounds total force when both handles are used simultaneously).

Figure 6:
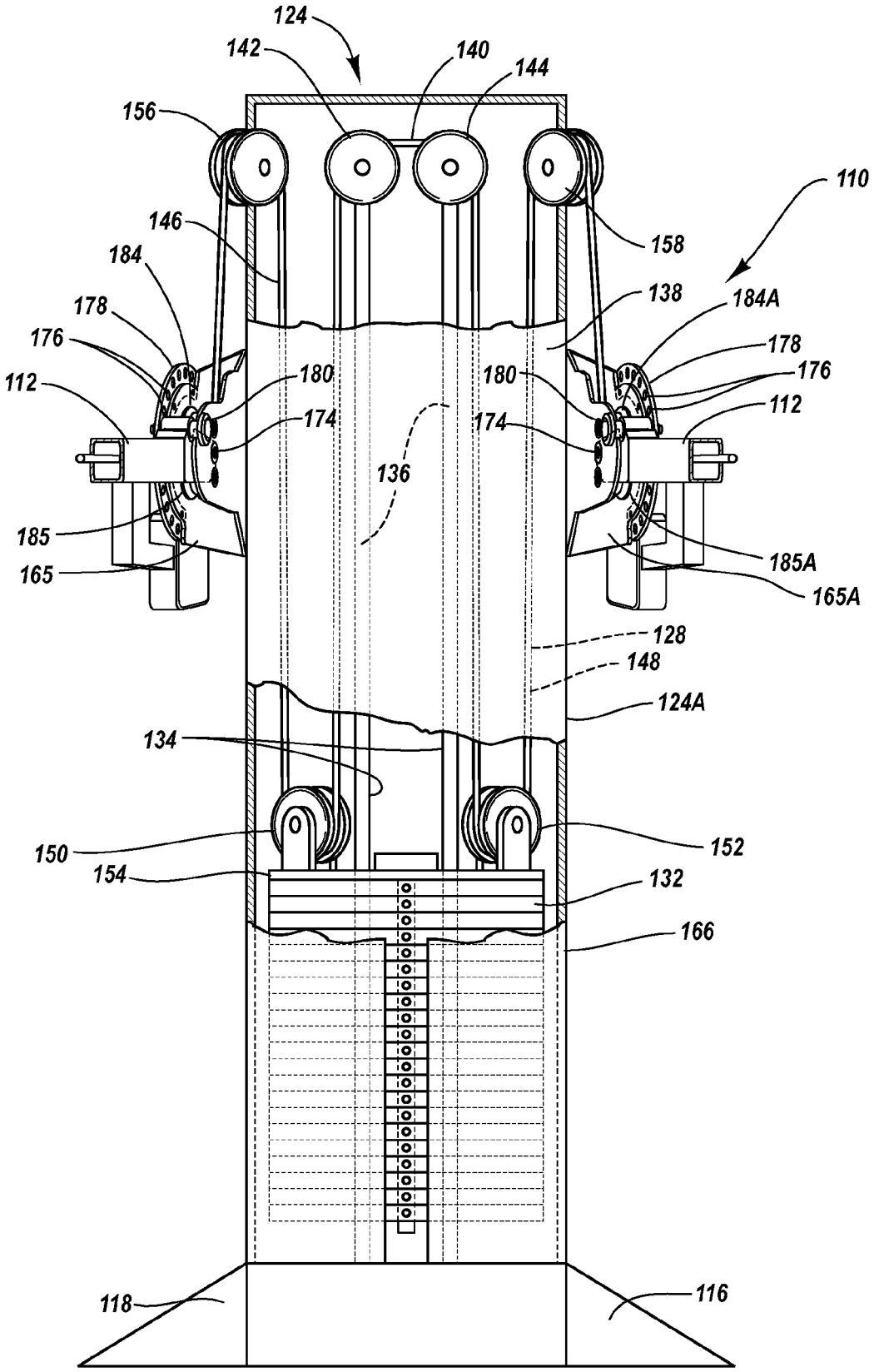
FIG. 6 is a front view of the exercise apparatus of FIG. 5 with the resistance assembly shown in partial cross section.
Figure 7:
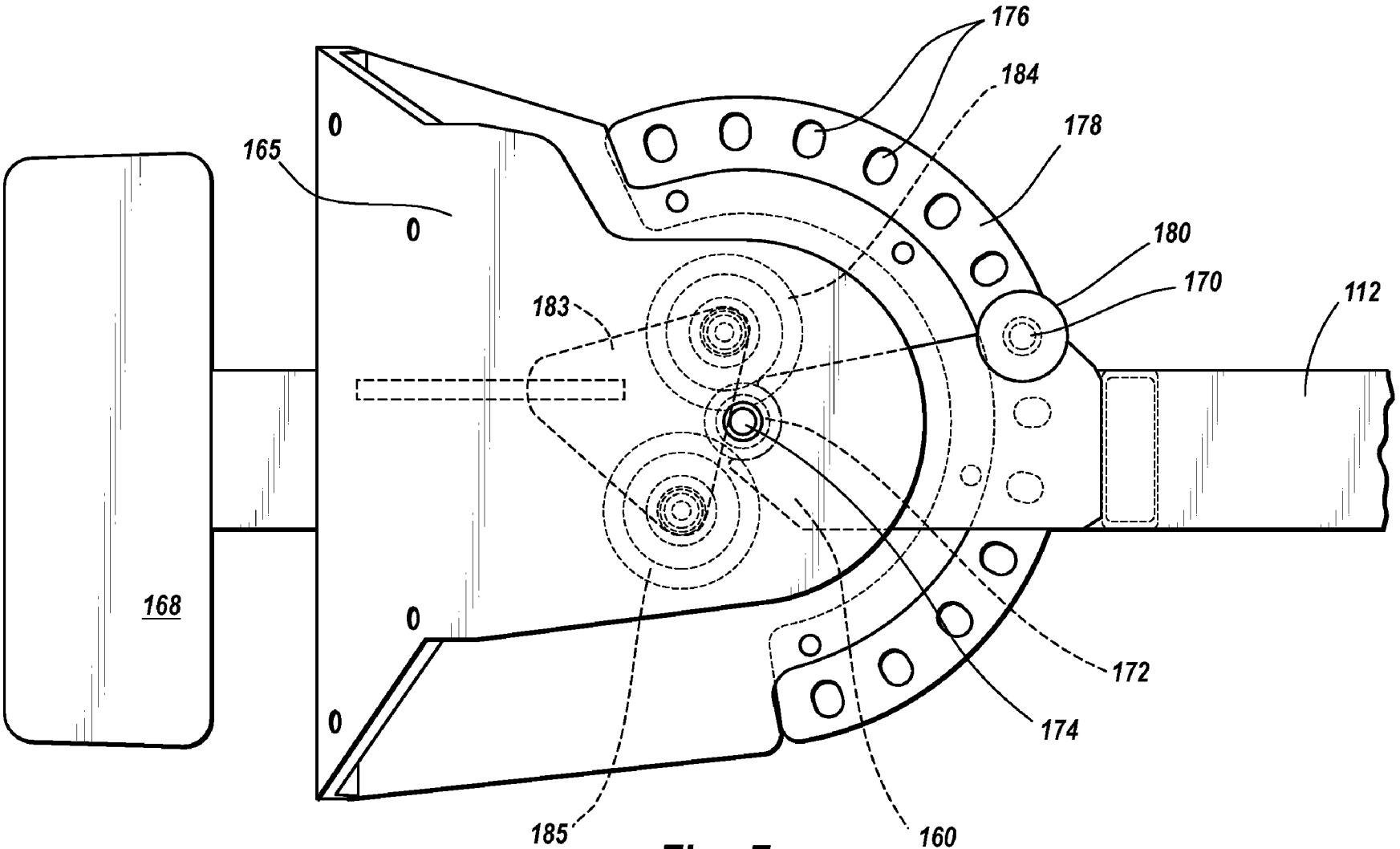
FIG. 7 is a side cutaway view of the mounting bracket assembly of the exercise apparatus of FIG. 5 (cable not shown).

With reference to FIG. 6, the weight stack assembly 124A secured to the central support member 118 includes support frame 134 having vertical support members 136 aligned to support a stack of weight plates 132. The weight plates 132 are supported for movement up and down in a conventional manner. The weight stack assembly 124A is covered by a protective sleeve 138 positioned thereabout.

When force is applied by the user, the cable 128 lifts the stack of weight plates 132. The central portion 140 of the cable 128 is passed over first and second central upper pulleys 142, 144.

First and second ends 146, 148 of the cable 128 then extend downwardly within the weight stack assembly 124A to respectively engage first and second movement pulleys 150, 152. The movement pulleys 150, 152 are attached to a coupling member 154 coupled to the stack of weight plates 132 (e.g. using a perforated selector rod and an insertable locking pin). In this way, upward movement of the movement pulleys 150, 152 causes the coupling member 154 to move upwardly, and ultimately lifts weight plates 132 upwardly against the force of gravity.

The first and second ends 146, 148 then extend upwardly and respectfully pass over respective first and second exit pulleys 156, 158. After passing over the exit pulleys 156, 158, and exiting the confines of the weight stack assembly 124A, the ends 146, 148 extend downwardly until they contact upper and lower guide pulleys 184, 184A, 185, 185A and then enter respective right and left extension arms 112, 114 which are discussed below in greater detail. Although a preferred orientation is disclosed for the various pulleys used in accordance with the present invention, those skilled in the art will readily understand that the exact orientation of the pulleys may be varied without departing from the spirit of the present invention.

The right and left extension arms 112, 114 are pivotally coupled to mounting brackets 165, 165A, which are fixed to a central portion of the weight stack assembly 124A. The right and left extension arms 112, 114 respectively rotate about a first axis and a second axis, which are positioned to orient the right and left extension arms 112, 114 in an opposed relationship. The right and left extension arms 112, 114 extend outwardly from the central support member 118. In this way, the ends of the extension arms 112, 114 are moved from the stack to improve user access to the present apparatus 110 while exercising. As those skilled in the art will readily appreciate, the exact angular orientation of the arms is not critical and may be varied slightly without departing from the spirit of present invention.

In the embodiment shown in FIGS. 5-8, the extension arms 112, 114 are substantially identical and will now be described with reference to at least the right extension arm 112. The right extension arm 112 includes a proximal end 160 and distal end 162. In accordance with the preferred embodiment of the present invention, the length of the right arm 112 is approximately 32 inches from pivot point 174 to the end 162, although those skilled in the art will appreciate that the length of the right extension arm 112 may be varied slightly without departing from the spirit of the present invention.

The right extension arm 112 is pivotally coupled, at a position near the proximal end 160 of the extension arm 112, to a mounting bracket 165, which may be secured to either the side or the front of weight stack assembly 124A. A semicircular flange assembly 178 is also secured to mounting bracket 165. The semicircular flange assembly 178 includes a pair of opposed flat plates and is mounted to lie within the plane in which the right extension arm 112 rotates as it moves relative to the weight stack assembly 124A. Movement of the right extension arm 112 is controlled by the inclusion of a counterweight 168 at the proximal end 160 of the right extension arm 112.

The right extension arm 112 is pivotally coupled in a manner allowing a user to select a desired orientation for the extension arm 112 and lock the extension arm 112 in place. Specifically, the right extension arm 112 includes a locking hole 170 located adjacent a pivot hole 172 through which a pivot pin 174 passes to pivotally couple the right extension arm 112 to the mounting bracket 165, and ultimately, the weight stack assembly 124A. The locking hole 170 is aligned with a series of flange holes 176 formed in the semicircular flange assembly 178 of the mounting bracket 165.

In practice, and as those skilled in the art will readily appreciate, a locking pin 180 is passed though an aligned locking hole 170 and flange hole 176 to lock the right extension arm 112 at a desired angular orientation relative to the weight stack assembly 124A. When a user desires to change the angular orientation of the right extension arm 112, the locking pin 180 is simply removed and the locking hole 170 is aligned with another flange hole 176 at which time the locking pin 180 is once again inserted in position to lock the right extension arm 112 relative to the weight stack assembly 124A.

First and second guide pulleys 184, 185 are fixed to the mounting bracket 165 near the proximal end 160 of the right arm 112. Corresponding third and fourth guide pulleys 184A, 185A, operate in a similar fashion with respect to the left extension arm 114. Pulleys 184 and 184A are upper pulleys, while pulleys 185 and 185A are lower pulleys.

Figure 5A:
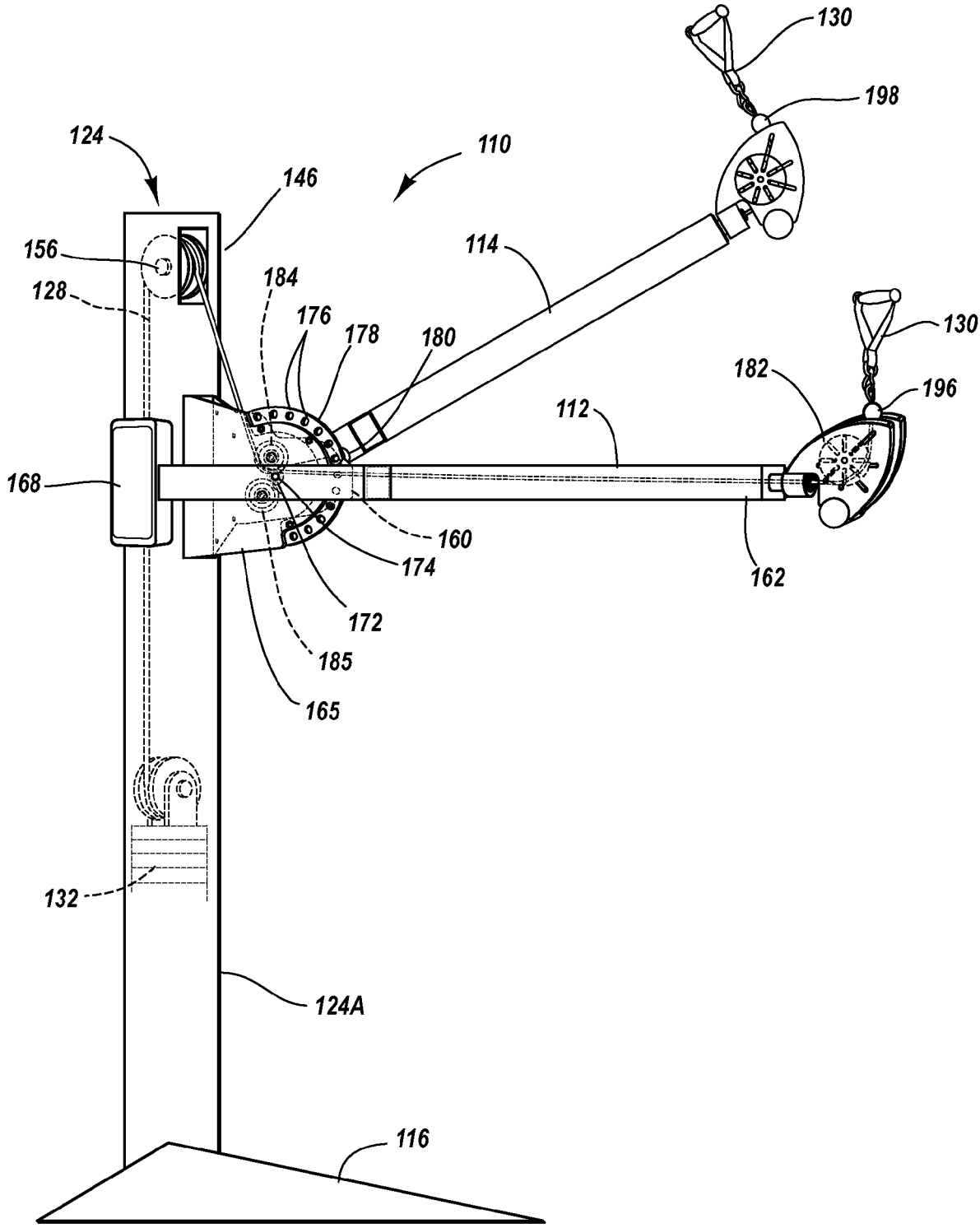
FIG. 5A is a side view of the an alternative exercise apparatus in accordance with the present invention demonstrating the cable contacting an upper pulley.
Figure 5B:
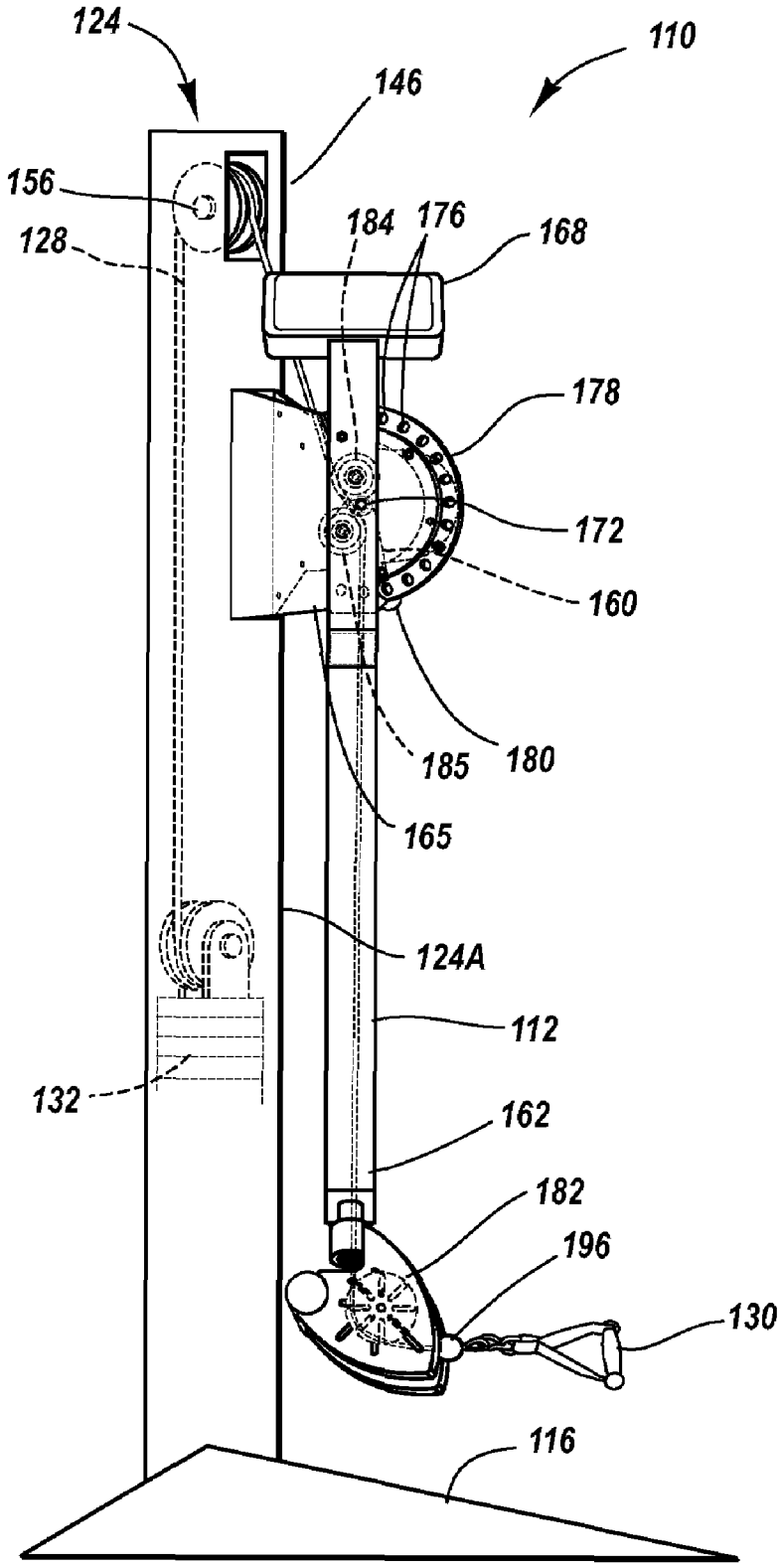
FIG. 5B is a side view of the exercise apparatus of FIG. 5 showing the extension arm in a fully lowered position and demonstrating the cable contacting a lower pulley.

Depending on the position of the extension arm 112, the first end 146 of the cable 128 passes over at least one of the guide pulleys 184, 185 (and possibly both guide pulleys) and then enters the tubular passageway formed in the right extension arm 112. As shown in FIG. 5A, if the right extension arm 112 is positioned at an upward angle from the horizontal, the first end 146 of the cable 128 comes down from pulley 156 at the top of weight stack assembly 124A, passes around the first guide pulley 184 and enters the tubular passageway in the right extension arm 112. As shown in FIG. 5B, if the right extension arm 112 is positioned at a sufficient downward angle, the first end 146 of the cable 128 comes down from pulley 156 at the top of weight stack assembly 124A, passes around both of the guide pulleys 184, 185, and enters the tubular passageway in the right extension arm 112. This orientation of the first and second guide pulleys 184, 185 allows the cable 128 to move freely within the tubular passageway without binding regardless of the orientation of the arms, and prevents substantial variations in tension as the arm 112 is moved upwardly or downwardly.

The distal end 162 of the right extension arm 112 is fitted with a pivoting pulley assembly 182 to guide the first end 146 of the cable 128 as it exits the right extension arm 112. The pivoting pulley assembly 182 can be exactly the same as or substantially the same as that disclosed in FIG. 4 and discussed above in substantial detail. Since the pivoting pulley assembly 182 permits a great degree of flexibility with regard to the angle at which the cable 128 is drawn from the right extension arm 112, the inclusion of the present pivoting pulley assembly 182 at the distal end of each extension arm 112, 114 greatly increases the flexibility of the present exercise apparatus.

The respective ends of the first and second ends 146, 148 are each provided with stop members 196, 198. As those skilled in the art will readily appreciate, the stop members 196, 198 control motion of the single cable to allow exercise by pulling the first end 146 alone, the second end 148 alone, or both ends at the same time. In use, and after the extension arms are properly positioned in a desired orientation, the user stands in front of the weight stack, grips the handles secured to the ends of the respective ends and performs desired lifting exercises.

Figure 8:
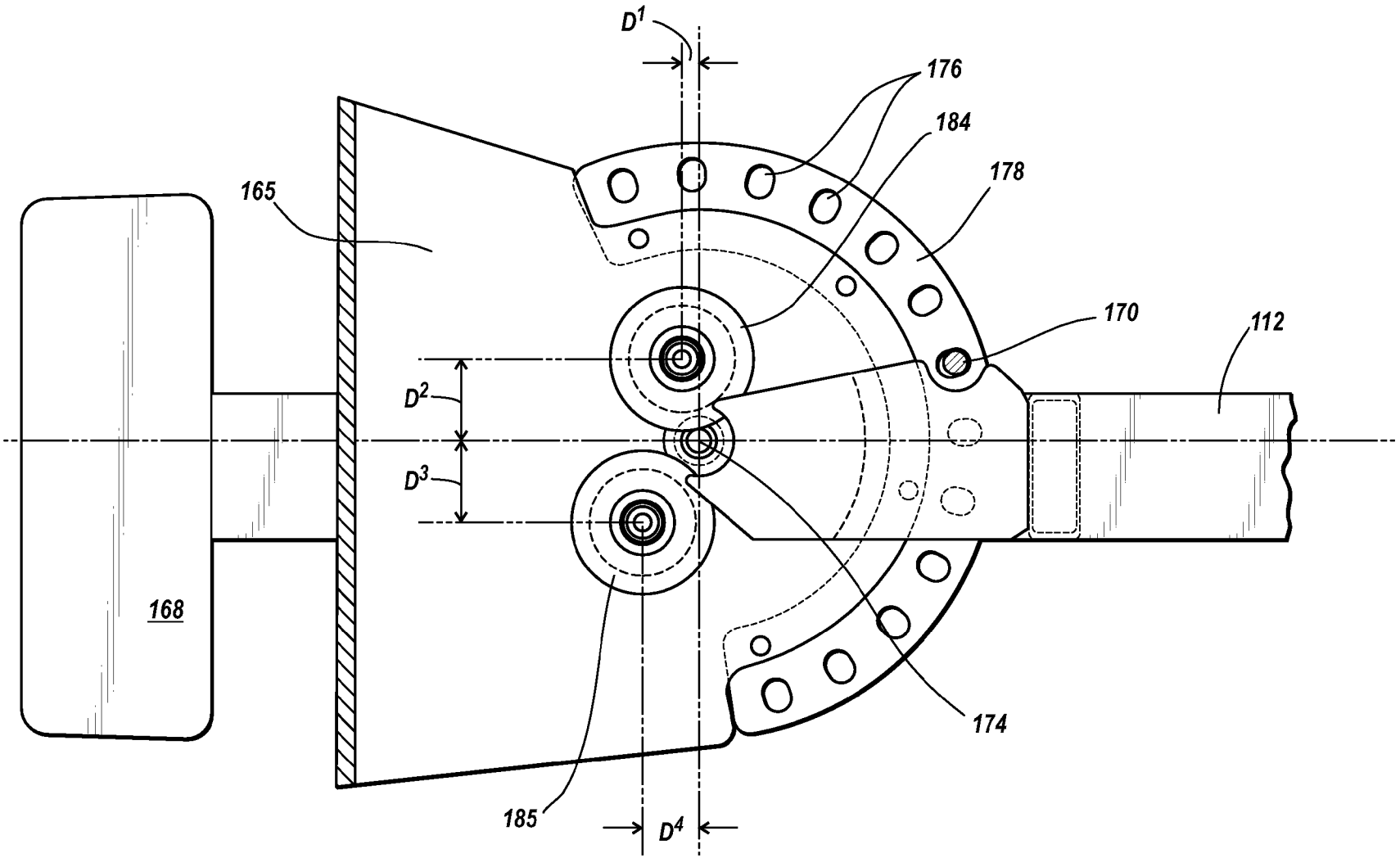
FIG. 8 is side cutaway view of the mounting bracket of FIG. 7 showing various offset distances (cable not shown).

With reference now to FIG. 8, an embodiment of the upper and lower pulleys of the present invention will now be discussed in additional detail. The pulleys 84, 84A, and/or 85, 85A described in FIGS. 1-4 may have similar or identical dimensions and relationships to those described now with reference to FIG. 8. In addition, the pulleys 184A, 185A may have identical or similar dimensions and relationships to those described now with reference to FIG. 8.

Upper and lower pulleys 184, 185 have axes of rotation that are substantially parallel to and offset from the axis of rotation of the extension arm 112. The axis of rotation of the upper pulley 184 is also offset from the axis of rotation of the extension arm 112 in the proximal direction a distance D1, and in the vertical direction a distance D2. The axis of the lower pulley 185 is also offset from the axis of rotation of the extension arm 112 in the proximal direction a distance D4, and in the vertical direction a distance D3. By orienting lower pulley 185 proximally with respect to upper pulley 184, as shown in FIGS. 8 and 5B, the cable is conveniently allowed to move along the distal portion of lower pulley 185 when arm 112 is in the lower position, providing space for the cable In one preferred embodiment, distance D1 is approximately ⅜ inch, distance D2 is approximately 1¾ inches, distance D3 is approximately 1 11/16 inches, and distance D4 is approximately 1 3/16 inches. In one embodiment, in order to optimize the relationships between the pulleys 184, 185 and the axis of arm 112, in addition to the distances discussed above, pulleys 184, 185 have a root diameter (the inside diameter portion actually contacted by the cable) of approximately 3 inches (e.g. 2 15/16 inches), and the cable has a diameter of about 3/16 inch. However, these distances are not intended to limit the invention, but rather to provide an example of an embodiment of the invention which minimizes variations in cable length and tension when the arms 112, 114 are moved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise apparatus, comprising:

a resistance assembly;

a cable configured to move against resistance provided by the resistance assembly;

wherein a right extension arm includes a proximal end pivotally coupled to the resistance assembly, and a free distal end, the right extension arm having a first axis of rotation, the exercise apparatus farther including a right first and a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley; and wherein a left extension arm includes a proximal end pivotally coupled to the resistance assembly, and a free distal end, the left extension arm having a second axis of rotation, the exercise apparatus farther including a left first and a left second pulley mounted adjacent the proximal end of the left extension arm, wherein the left first pulley is mounted at a fixed distance above the left second pulley such that an axis of rotation of the left first pulley is offset distally with respect to the axis of rotation of the left second pulley.

2. An exercise apparatus as recited in claim 1, wherein each of the first and second right and left pulleys are mounted on the resistance assembly, each of the right first and right second pulleys has an axis of rotation offset from and substantially parallel to the first axis of rotation, and each of the left first and left second pulleys has an axis of rotation offset from and substantially parallel to the second axis of rotation.

3. An exercise apparatus as recited in claim 1 wherein the right first pulley is mounted on the resistance assembly and the right second pulley is mounted on the resistance assembly lower than the right first pulley.

4. An exercise apparatus as recited in claim 1 wherein the left first pulley is mounted on the resistance assembly and the left second pulley is mounted on the resistance assembly lower than the left first pulley.

5. An exercise apparatus as recited in claim 1 wherein the exercise apparatus comprises a single cable.

6. An exercise apparatus, comprising:

a resistance assembly;

a cable extending along a right extension arm and along a left extension arm, wherein the cable is moveable against resistance provided by the resistance assembly, and wherein the cable includes a first and second end;

wherein the right extension arm includes a proximal end pivotally coupled to the resistance assembly, and a free distal end from which the first end of the cable extends for engagement by a user, the right extension arm having a first axis of rotation, the exercise apparatus further including a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley; and wherein the left extension arm includes a proximal end pivotally coupled to the resistance assembly, and a free distal end from which the second end of the cable extends for engagement by a user, the left extension arm having a second axis of rotation, the exercise apparatus further including a left first and a left second pulley mounted adjacent the proximal end of the left extension arm, wherein the left first pulley is mounted at a fixed distance above the left second pulley such that an axis of rotation of the left first pulley is offset distally with respect to the axis of rotation of the left second pulley.

7. An exercise apparatus as recited in claim 6, wherein each of the first and second right and left pulleys are mounted on the resistance assembly, each of the right first and right second pulleys has an axis of rotation offset from and substantially parallel to the first axis of rotation, and each of the left first and left second pulleys has an axis of rotation offset from and substantially parallel to the second axis of rotation.

8. An exercise apparatus as recited in claim 6 wherein the right first pulley is mounted on the resistance assembly and the right second pulley is mounted on the resistance assembly lower than the right first pulley.

9. An exercise apparatus as recited in claim 8, wherein the first end of the cable contacts at least one of the right first and right second pulleys and then enters the proximal end of the right extension arm and exits the distal end of the right extension arm, and the second end of the cable contacts at least one of the left first and left second pulleys and then enters the proximal end of the left extension arm and exits the distal end of the left extension arm.

10. An exercise apparatus as recited in claim 6 wherein the left first pulley is mounted on the resistance assembly and the left second pulley is mounted on the resistance assembly lower than the left first pulley.

11. An exercise apparatus, comprising:

a resistance assembly;

a cable extending along a right extension arm and along a left extension arm, wherein the cable is moveable against resistance provided by the resistance assembly, and wherein the cable includes a first end and a second end;

wherein the right extension arm includes a proximal end pivotally coupled to the resistance assembly, and a free distal end from which the first end of the cable extends, the right extension arm having a first axis of rotation, the exercise apparatus farther including a right first and a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley, the cable extending along one side of the right first pulley and along an opposite side of the right second pulley;

wherein the left extension arm includes a proximal end pivotally coupled to the resistance assembly, and a free distal end from which the second end of the cable extends, the left extension arm having a second axis of rotation, the exercise apparatus farther including a left first and a left second pulley mounted adjacent the proximal end of the left extension arm, wherein the left first pulley is mounted at a fixed distance from the left second pulley such that an axis of rotation of the left first pulley is offset distally with respect to the axis of rotation of the left second pulley, the cable extending along one side of the left first pulley and along an opposite side of the left second pulley;

a first pivoting pulley assembly coupled to the distal end of the right extension arm; and a second pivoting pulley assembly coupled to the distal end of the left extension arm.

12. An exercise apparatus as recited in claim 11, wherein each of the first and second right and left pulleys are mounted on the resistance assembly, each of the right first and right second pulleys has an axis of rotation offset from and substantially parallel to the first axis of rotation, and each of the left first and left second pulleys has an axis of rotation offset from and substantially parallel to the second axis of rotation.

13. An exercise apparatus as recited in claim 11 wherein the right first pulley is mounted on the resistance assembly and the right second pulley is mounted on the resistance assembly lower than the right first pulley.

14. An exercise apparatus as recited in claim 13, wherein the first end of the cable contacts at least one of the right first and right second pulleys and then enters the proximal end of the right extension arm and exits the distal end of the right extension arm, and the second end of the cable contacts at least one of the left first and left second pulleys and then enters the proximal end of the left extension arm and exits the distal end of the left extension arm.

15. An exercise apparatus as recited in claim 11 wherein the left first pulley is mounted on the resistance assembly and the left second pulley is mounted on the resistance assembly lower than the left first pulley.

16. An exercise apparatus as recited in claim 11, wherein each pivoting pulley assembly comprises: a pulley member; and a pivoting pulley frame.

17. An exercise apparatus as recited in claim 11, wherein the cable extends from the proximal end of the right extension arm to the first pivoting pulley assembly coupled to the distal end of the right extension arm and the cable extends from the proximal end of the left extension arm to the second pivoting pulley assembly coupled to the distal end of the left extension arm.

18. An exercise apparatus, comprising:

a resistance assembly including a first and second flange;

a cable extending along a right extension arm and along a left extension arm, wherein the cable is moveable against resistance provided by the resistance assembly, and wherein the cable includes a first end and a second end;

wherein the right extension arm includes a proximal end pivotally coupled to the first flange, and a free distal end from which the first end of the cable extends, the right extension arm having a first axis of rotation, the exercise apparatus farther including a right first and a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley, the axis of rotation of the right extension arm being vertically between and horizontally distal to the axes of rotation of the right first and second pulleys; and wherein the left extension arm includes a proximal end pivotally coupled to the second flange, and a free distal end from which the second end of the cable extends, the left extension arm having a second axis of rotation, the exercise apparatus farther including a left first and a left second pulley mounted adjacent the proximal end of the left extension arm, wherein the left first pulley is mounted at a fixed distance above the left second pulley such that an axis of rotation of the left first pulley is offset distally with respect to the axis of rotation of the left second pulley, the axis of rotation of the left extension arm being vertically between and horizontally distal to the axes of rotation of the left first and second pulleys.

19. An exercise apparatus as recited in claim 18, wherein each of the first and second right and left pulleys are mounted on the first and second flanges, respectively, each of the right first and right second pulleys has an axis of rotation offset from and substantially parallel to the first axis of rotation, and each of the left first and left second pulleys has an axis of rotation offset from and substantially parallel to the second axis of rotation.

20. An exercise apparatus as recited in claim 19 wherein the right first pulley is mounted on the first flange and the right second pulley is mounted on the first flange lower than the right first pulley.

21. An exercise apparatus as recited in claim 20, wherein the first end of the cable contacts at least one of the right first and right second pulleys and then enters the proximal end of the right extension arm and exits the distal end of the right extension arm, and the second end of the cable contacts at least one of the left first and left second pulleys and then enters the proximal end of the left extension arm and exits the distal end of the left extension arm.

22. An exercise apparatus as recited in claim 19 wherein the left first pulley is mounted on the second flange and the left second pulley is mounted on the second flange lower than the left first pulley.

23. An exercise apparatus as recited in claim 18 further comprising:

a first locking pin configured to selectively lock the first extension arm into a desired position with respect to the first flange; and a second locking pin configured to selectively lock the second extension arm into a desired position with respect to the second flange.

24. An exercise apparatus as recited in claim 18, wherein the right extension arm and the left extension arm are substantially parallel as they extend from the resistance assembly.

25. An exercise apparatus, comprising:

a resistance assembly;

a cable extending along a right extension arm and along a left extension arm, wherein the cable is moveable against resistance provided by the resistance assembly, and wherein the cable includes a first end and a second end;

wherein the right extension arm and the left extension arm are capable of independent movement;

wherein the right extension arm includes a proximal end pivotally coupled to the resistance assembly, and a free distal end from which the first end of the cable extends, the right extension arm having a first axis of rotation, the exercise apparatus farther including a right first and a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley, the axis of rotation of the right extension arm being vertically between and horizontally distal to the axes of rotation of the right first and second pulleys, the cable extending along one side of the right first pulley and along an opposite side of the right second pulley; and wherein the left extension arm includes a proximal end pivotally coupled to the resistance assembly, and a free distal end from which the second end of the cable extends, the left extension arm having a second axis of rotation, the exercise apparatus farther including a left first and a left second pulley mounted adjacent the proximal end of the left extension arm, wherein the left first pulley is mounted at a fixed distance above the left second pulley such that an axis of rotation of the left first pulley is offset distally with respect to the axis of rotation of the left second pulley, the axis of rotation of the left extension arm being vertically between and horizontally distal to the axes of rotation of the left first and second pulleys, the cable extending along one side of the left first pulley and along an opposite side of the left second pulley.

26. An exercise apparatus as recited in claim 25, wherein each of the first and second right and left pulleys are mounted on the resistance assembly, each of the right first and right second pulleys has an axis of rotation offset from and substantially parallel to the first axis of rotation, and each of the left first and left second pulleys has an axis of rotation offset from and substantially parallel to the second axis of rotation.

27. An exercise apparatus as recited in claim 25 wherein the right first pulley is mounted on the resistance assembly and the right second pulley is mounted on the resistance assembly lower than the right first pulley.

28. An exercise apparatus as recited in claim 27, wherein the first end of the cable contacts at least one of the right first and right second pulleys and then enters the proximal end of the right extension arm and exits the distal end of the right extension arm, and the second end of the cable contacts at least one of the left first and left second pulleys and then enters the proximal end of the left extension arm and exits the distal end of the left extension arm.

29. An exercise apparatus as recited in claim 25 wherein the left first pulley is mounted on the resistance assembly and the left second pulley is mounted on the resistance assembly lower than the left first pulley.

30. An exercise apparatus as recited in claim 25, wherein the right extension arm and the left extension arm are substantially parallel as they extend from the resistance assembly.

31. An exercise apparatus, comprising:

a resistance assembly;

a cable and pulley system, having a cable configured to move against resistance provided by the resistance assembly;

wherein the right extension arm includes a proximal end pivotally coupled to the resistance assembly, and a free distal end, the right extension arm having a first axis of rotation, the cable and pulley system further comprising a right first and a right second pulley mounted adjacent the proximal end of the right extension arm, wherein the right first pulley is mounted at a fixed distance above the right second pulley such that an axis of rotation of the right first pulley is offset distally with respect to the axis of rotation of the right second pulley, wherein when the right extension arm is raised the cable contacts the right first pulley and when the right extension arm is lowered the cable contacts both right first and second pulleys; and wherein the left extension arm includes a proximal end pivotally coupled to the resistance assembly, and a free distal end, the left extension arm having a second axis of rotation, the cable and pulley system further comprising a left first and a left second pulley mounted adjacent the proximal end of the left extension arm, wherein the left first pulley is mounted at a fixed distance above the left second pulley such that an axis of rotation of the left first pulley is offset distally with respect to the axis of rotation of the left second pulley, wherein when the left extension arm is raised the cable contacts the left first pulley and when the left extension arm is lowered the cable contacts both left first and second pulleys.

32. An exercise apparatus as recited in claim 31, wherein each of the first and second right and left pulleys are mounted on the resistance assembly, each of the right first and right second pulleys has an axis of rotation offset from and substantially parallel to the first axis of rotation, and each of the left first and left second pulleys has an axis of rotation offset from and substantially parallel to the second axis of rotation.

33. An exercise apparatus as recited in claim 31 wherein the right first pulley is mounted on the resistance assembly and the right second pulley is mounted on the resistance assembly lower than the right first pulley.

34. An exercise apparatus as recited in claim 31 wherein the left first pulley is mounted on the resistance assembly and the left second pulley is mounted on the resistance assembly lower than the left first pulley.

35. An exercise apparatus as recited in claim 31 wherein the exercise apparatus comprises a single cable.

* * * * *

UNITED STATES PATENT AND TRADEMARK OFFICE

CERTIFICATE OF CORRECTION

PATENT NO. : 7,625,321 B2
APPLICATION NO. : 11/627322
DATED : December 1, 2009
INVENTOR(S) : Simonson et al.

It is certified that error appears in the above-identified patent and that said Letters Patent is hereby corrected as shown below:

On the Title Page
Item (57) Abstract, Line 1, change "apparatuses" to --apparatus--
Item (56) page 3, Line 15, change "Claim1" to --Claim 1--
Item (56) page 3, Line 25, change "'061," to --'061 Patent,--
Item (56) page 3, Lines 31-32, change "Judgement No Literal" to --Judgement of No Literal--
Item (56) page 4, Line 52, change "availabel" to --available--

Column 9
Line 1, change "farther" to --further--
Line 11, change "farther" to --further--
Line 40, change "first and second" to --first end and a second--
Line 46, change "a right second" to --a right first and a right second--

Column 10
Line 30, change "farther" to --further--
Line 43, change "farther" to --further--
Line 46, change "distance from the" to --distance above the--

Column 11
Line 34, change "farther" to --further--
Line 48, change "farther" to --further--

Column 12
Line 42, change "farther" to --further--
Line 58, change "farther" to --further--

Signed and Sealed this

Eighth Day of June, 2010

David J. Kappos

David J. Kappos
*Director of the United States Patent and Trademark Office*